US008213851B2

(12) United States Patent
Shoji et al.

(10) Patent No.: US 8,213,851 B2
(45) Date of Patent: Jul. 3, 2012

(54) CONVEYING DEVICE AND IMAGE FORMING APPARATUS

(75) Inventors: Yutaka Shoji, Ibaraki (JP); Junji Shirakawa, Ibaraki (JP); Takayuki Muneyasu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 744 days.

(21) Appl. No.: 12/076,045

(22) Filed: Mar. 13, 2008

(65) Prior Publication Data

US 2008/0232879 A1 Sep. 25, 2008

(30) Foreign Application Priority Data

Mar. 23, 2007 (JP) ..... 2007-075865
Mar. 29, 2007 (JP) ..... 2007-086706

(51) Int. Cl.
*G03G 15/00* (2006.01)

(52) U.S. Cl. ..... 399/395; 399/394

(58) Field of Classification Search ..... 399/395
See application file for complete search history.

(56) References Cited

U.S. PATENT DOCUMENTS

| | | | | |
|---|---|---|---|---|
| 4,257,586 | A * | 3/1981 | Weisbach | 271/235 |
| 5,078,384 | A * | 1/1992 | Moore | 271/228 |
| 6,019,365 | A * | 2/2000 | Matsumura | 271/227 |
| 6,276,586 | B1 * | 8/2001 | Yeo et al. | 226/17 |
| 6,502,818 | B1 | 1/2003 | Nonaka et al. | |
| 7,422,209 | B2 * | 9/2008 | Hashimoto | 271/228 |
| 7,467,793 | B2 * | 12/2008 | Tanabe | 271/245 |
| 7,650,823 | B2 * | 1/2010 | Iguchi | 83/13 |
| 7,775,519 | B2 * | 8/2010 | Takahashi et al. | 271/258.01 |
| 2002/0039507 | A1 | 4/2002 | Kawasumi et al. | |
| 2004/0188929 | A1 * | 9/2004 | Tada et al. | 271/248 |
| 2005/0035539 | A1 * | 2/2005 | Hashimoto | 271/265.01 |
| 2005/0265761 | A1 * | 12/2005 | Kawaai et al. | 399/394 |

FOREIGN PATENT DOCUMENTS

| | | |
|---|---|---|
| DE | 141 149 | 4/1980 |
| DE | 30 02 594 | 8/1980 |
| EP | 0 968 944 | 1/2000 |
| EP | 0 992 860 | 4/2000 |
| EP | 1 870 358 | 12/2007 |
| GB | 2 228 727 | 9/1990 |
| JP | 03-009373 | 1/1991 |
| JP | 03-094275 | 4/1991 |
| JP | 05-124752 | 5/1993 |
| JP | 07-157145 | 6/1995 |
| JP | 10-067448 | 3/1998 |
| JP | 2893540 | 3/1999 |
| JP | 11-268843 | 10/1999 |
| JP | 2002-265097 | 9/2002 |
| JP | 2005-022820 | 1/2005 |

OTHER PUBLICATIONS

Applicants enclose an English Language Abstrat for Japanese Patent Publication No. JP 03-094275 dated Apr. 19, 1991.
European Search Report dated May 25, 2010.
Japanese Office Action dated Sep. 10, 2009.
European Office Action, dated Nov. 26, 2009.
Office Action for corresponding Japanese patent application No. 2007-075865 dated Jan. 18, 2011.

* cited by examiner

*Primary Examiner* — Anthony Nguyen
(74) *Attorney, Agent, or Firm* — Harness, Dickey & Pierce, P.L.C.

(57) ABSTRACT

A first longitudinal registration correcting unit corrects a misalignment of a recording medium in its conveying direction. A lateral registration correcting unit corrects a misalignment of the recording medium in its width direction after the misalignment in the conveying direction is corrected by the first longitudinal registration correcting unit. A second longitudinal registration correcting unit corrects the misalignment of the recording medium in the conveying direction again after the misalignment in the width direction is corrected by the lateral registration correcting unit.

9 Claims, 7 Drawing Sheets

CONVEYING DEVICE AND IMAGE FORMING APPARATUS

CROSS-REFERENCE TO RELATED APPLICATIONS

The present application claims priority to and incorporates by reference the entire contents of Japanese priority documents 2007-075865 filed in Japan on Mar. 23, 2007 and 2007-086706 filed in Japan on Mar. 29, 2007.

BACKGROUND OF THE INVENTION

1. Field of the Invention

The present invention relates to a technology for conveying a recording medium to an image transfer unit in an electrophotographic image forming apparatus.

2. Description of the Related Art

In an image forming apparatus, such as a copier and a printer, a recording medium is conveyed by a registration roller unit to an image transfer unit at the right time, as described in, for example, Japanese Patent No. 2893540 and Japanese Patent Application Laid-open No. 2002-265097. Specifically, the technology for conveying the recording medium is designed to accurately transfer an image carried on an image carrier, such as a photosensitive drum and an intermediate transfer belt, to the right position on the recording medium without any misalignment of the image. The term "misalignment" mentioned here indicates "deviation" from a predetermined position to which the image is supposed to be transferred.

More specifically, Japanese Patent No. 2893540 discloses a technology for butting a recording medium against a butting member (gate device) to position a leading edge of the recording medium, holding the recording medium by a registration roller unit provided on the downstream side of the butting member, moving the registration roller unit in a width direction of the recording medium in the state of holding the recording medium thereby, correcting the misalignment of the recording medium in its width direction (direction perpendicular to a conveying direction), and then conveying the recording medium to the image transfer unit.

Japanese Patent Application Laid-open No. 2002-265097 discloses a technology for butting a recording medium against a butting member (butting surface) to correct a skew of the recording medium, and then conveying the recording medium to the image transfer unit by a registration roller unit provided on the upstream side of the butting member.

However, in the conventional technologies, there may be a case where the misalignment of the recording medium is not fully corrected and an image is not thereby accurately transferred to the right position on the recording medium.

Specifically, in the technologies disclosed in Japanese Patent No. 2893540 and Japanese Patent Application Laid-open No. 2002-265097, the recording medium is held by the roller unit provided on the upstream side of the butting member after the recording medium is butted against the butting member. At this time, the leading edge of the recording medium butted against the butting member is displaced caused by a difference in rigidity of recording media or the like, and the position in the conveying direction (hereinafter, "longitudinal registration" as necessary) thereby deviates, to cause a deviation of a transfer start position of an image with respect to the recording medium conveyed to the image transfer unit.

Moreover, in the technology disclosed in Japanese Patent No. 2893540, even when the deviation of a position of the recording medium in its width direction (hereinafter, "lateral registration" as necessary) is corrected in a state of holding the recording medium by the registration roller unit provided on the downstream side of the butting member, another deviation may occur in the longitudinal registration of the recording medium.

Particularly, these problems cannot be ignored because deviations or skews of the longitudinal registration and the lateral registration of the recording medium may easily occur in a high-speed image forming apparatus in which the recording medium is conveyed at a high speed.

Furthermore, in the conventional technologies, there are some cases where the skew of the recording medium is not fully corrected and thus the image is not appropriately transferred to the right position on the recording medium.

More specifically, there is a case where the butting member is not accurately assembled in the conveying device and the butting member is thereby tilted in the width direction with respect to the conveying direction of the recording medium. In this case, if the entire leading edge of the recording medium butts against the tilted butting member, then the butting results in occurrence of a skew, corresponding to the tilt of the butting member, in the recording medium of which skew should be corrected. Such a problem as above becomes particularly significant when the butting member is unitized and is, therefore, detachably attached to the conveying device.

Furthermore, when specific skew occurs depending on a type of the recording medium and the use environment of the device, even if the skew of the recording medium is corrected at the position of the butting member, the recording medium is again skewed during conveyance of the recording medium from the butting member to the image transfer unit, and thus the image cannot be formed at the right position on the recording medium.

Particularly, such a problem cannot be ignored because the skew of the recording medium easily occurs in a high-speed image forming apparatus in which the recording medium is conveyed at a high speed.

SUMMARY OF THE INVENTION

It is an object of the present invention to at least partially solve the problems in the conventional technology.

According to an aspect of the present invention, there is provided a conveying device that conveys a recording medium to an image transfer unit that transfers an image formed on an image carrier to the recording medium. The conveying device includes a first longitudinal registration correcting unit that corrects a misalignment of the recording medium in its conveying direction; a lateral registration correcting unit that corrects a misalignment of the recording medium in its width direction after the first longitudinal registration correcting unit corrects the misalignment of the recording medium in the conveying direction; and a second longitudinal registration correcting unit that corrects the misalignment of the recording medium in the conveying direction again after the lateral registration correcting unit corrects the misalignment of the recording medium in the width direction.

Furthermore, according to another aspect of the present invention, there is provided an image forming apparatus including a conveying device that conveys a recording medium to an image transfer unit that transfers an image formed on an image carrier to the recording medium. The conveying device includes a first longitudinal registration correcting unit that corrects a misalignment of the recording medium in its conveying direction, a lateral registration correcting unit that corrects a misalignment of the recording medium in its width direction after the first longitudinal registration correcting unit corrects the misalignment of the recording medium in the conveying direction, and a second longitudinal registration correcting unit that corrects the misalignment of the recording medium in the conveying direction again after the lateral registration correcting unit corrects the misalignment of the recording medium in the width direction.

Moreover, according to still another aspect of the present invention, there is provided a conveying device that conveys a recording medium to an image transfer unit that transfers an image formed on an image carrier to the recording medium. The conveying device includes a butting member that closes a conveying path of the recording medium to cause a leading edge of the recording medium moving along the conveying path to butt against the butting member, and then opens the conveying path; and an adjusting unit that adjusts a tilt of the butting member in a width direction with respect to a conveying direction of the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
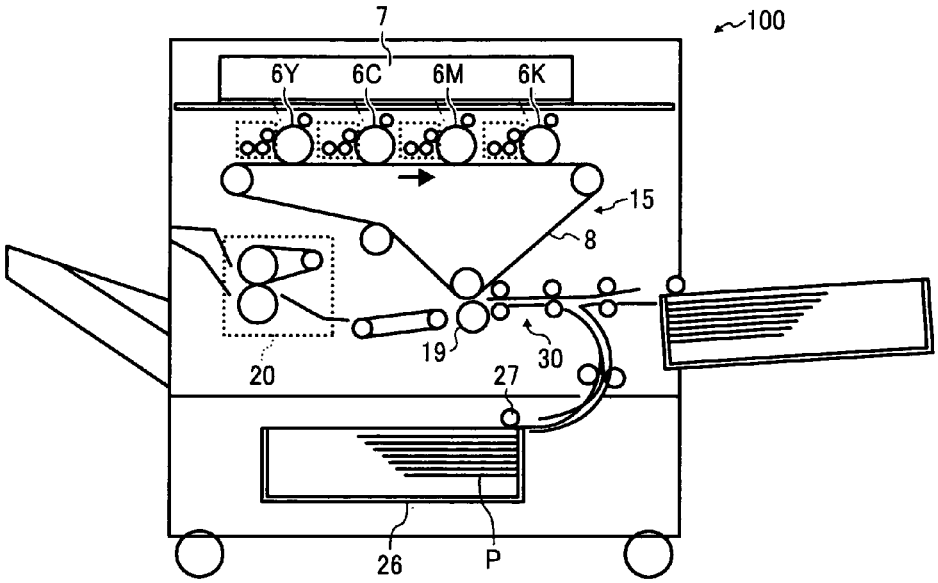
FIG. 1 is a schematic diagram of an overall image forming apparatus according to the present invention.

Exemplary embodiments of the present invention are explained in detail below with reference to the accompanying drawings. Same reference numerals or letters are assigned to components the same as or corresponding to each other in the drawings and explanation thereof is, therefore, simplified or omitted.

Figure 2:
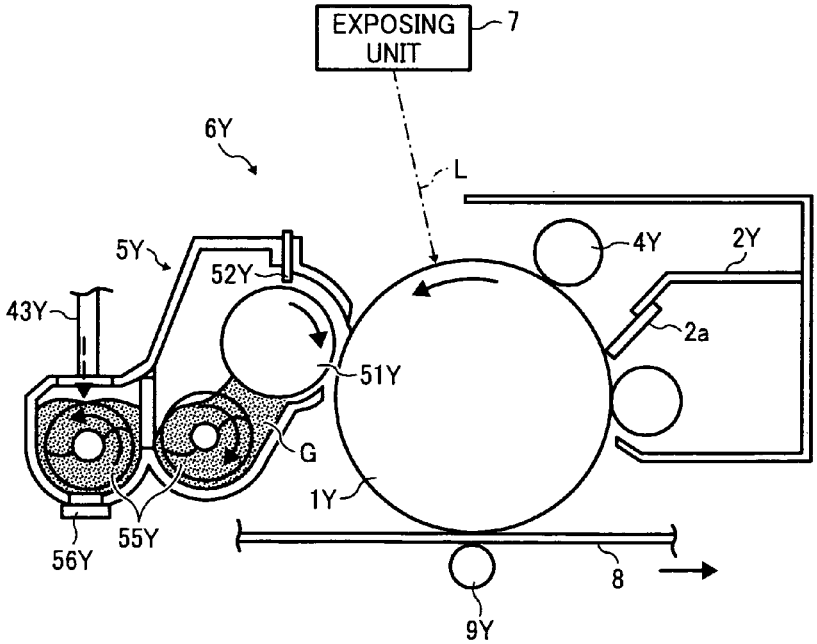
FIG. 2 is a cross section of an imaging unit of FIG. 1.

The configuration and operations of an overall image forming apparatus are explained first with reference to FIGS. 1 and 2.

FIG. 1 is a schematic diagram of a printer as the image forming apparatus, and FIG. 2 is an enlarged view of an imaging unit of the printer.

Figure 5:
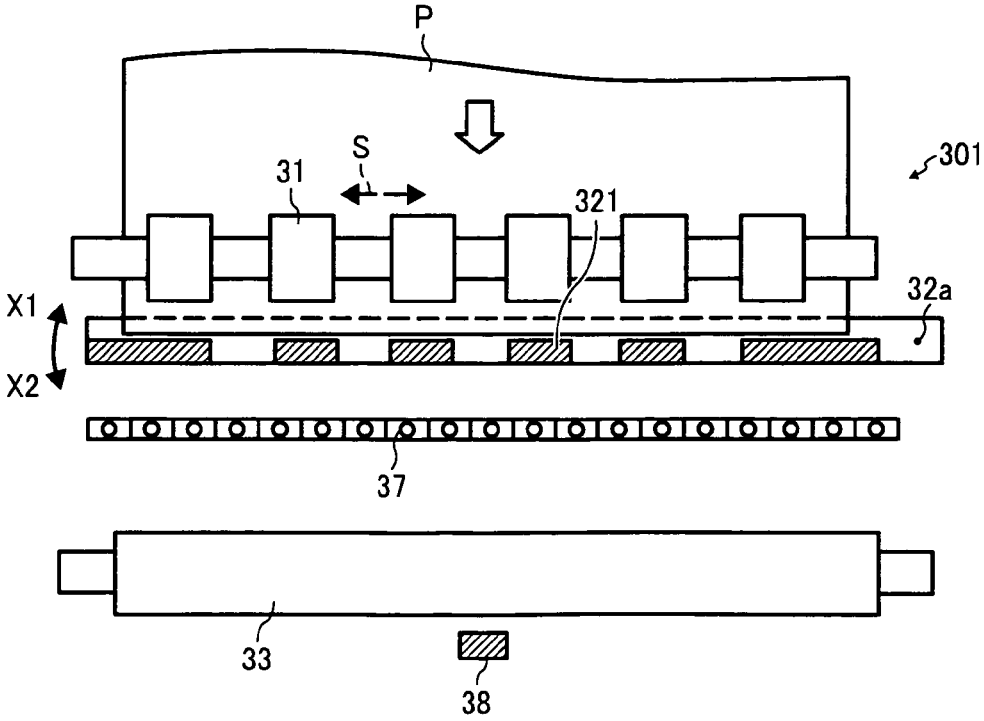
FIG. 5 is a top view of a conveying device according to a second embodiment of the present invention when viewed from its width direction.

As shown in FIG. 1, an intermediate transfer belt unit 15 is installed at the center of the body of an image forming apparatus 100. Imaging units 6Y, 6M, 6C, and 6K corresponding to colors such as yellow, magenta, cyan, and black respectively are also arranged so as to face an intermediate transfer belt 8 of the intermediate transfer belt unit 15. A conveying device 30 according to a first embodiment is provided on the lower right side of the intermediate transfer belt unit 15. The conveying device 30 shown in FIGS. 1 and 3 includes a conveying device 301 according to a second embodiment as shown in FIG. 5 unless otherwise specified.

Referring to FIG. 2, the imaging unit 6Y corresponding to yellow includes a photosensitive drum 1Y as an image carrier, and also includes a charging unit 4Y, a developing unit 5Y, a cleaning unit 2Y, and a neutralizing unit (not shown) which are arranged around the periphery of the photosensitive drum 1Y. And imaging processes such as a charging process, an exposing process, a developing process, a transfer process, and a cleaning process are performed on the photosensitive drum 1Y to form a yellow image on the photosensitive drum 1Y.

The other three imaging units 6M, 6C, and 6K have configurations almost the same as that of the imaging unit 6Y except for the colors of toner used therein respectively, and images corresponding to respective toner colors are formed. Therefore, explanation of the three imaging units 6M, 6C, and 6K are omitted if not needed, and only the imaging unit 6Y is explained below.

Referring to FIG. 2, the photosensitive drum 1Y is made to rotate in the counterclockwise direction in FIG. 2 by a drive motor (not shown). The surface of the photosensitive drum 1Y is uniformly charged at a position of the charging unit 4Y (charging process).

Thereafter, the surface of the photosensitive drum 1Y reaches a position where laser light L emitted from an exposing unit 7 is radiated, to form an electrostatic latent image corresponding to yellow through scanning and exposure with the light (exposing process).

The surface of the photosensitive drum 1Y then reaches a position facing the developing unit 5Y, where the electrostatic latent image is developed to form a toner image of yellow (developing process).

Thereafter, the surface of the photosensitive drum 1Y reaches a position where the intermediate transfer belt 8 and a transfer roller 9Y face each other and the toner image on the photosensitive drum 1Y is transferred to the intermediate transfer belt 8 (primary transfer process). At this process, non-transferred toner slightly remains on the photosensitive drum 1Y.

The surface of the photosensitive drum 1Y then reaches a position facing the cleaning unit 2Y, where the non-transferred toner remaining on the photosensitive drum 1Y is collected into the cleaning unit 2Y by a cleaning blade 2*a* (cleaning process).

Lastly, the surface of the photosensitive drum 1Y reaches a position facing the neutralizing unit (not shown), where any residual potential is removed from the photosensitive drum 1Y.

A series of the imaging processes performed on the photosensitive drum 1Y are finished in the above manner.

Imaging processes performed in the other imaging units 6M, 6C, and 6K are the same as these in the imaging unit 6Y. Specifically, the exposing unit 7 is provided in the upper side of the imaging units, and the laser light L based on image information is radiated from the exposing unit 7 to photosensitive drums 1M, 1C, and 1K of the imaging units 6M, 6C, and 6K, respectively. More specifically, the exposing unit 7 emits the laser light L from a light source and radiates the laser light L to the photosensitive drum via a plurality of optical elements while scanning the laser light L by a polygon mirror which is made to rotate.

Thereafter, the toner images of the colors formed respectively on the photosensitive drums via the developing process are transferred one on top of another onto the intermediate transfer belt 8 as the image carrier. In this manner, a color image is formed on the intermediate transfer belt 8.

Figure 3:
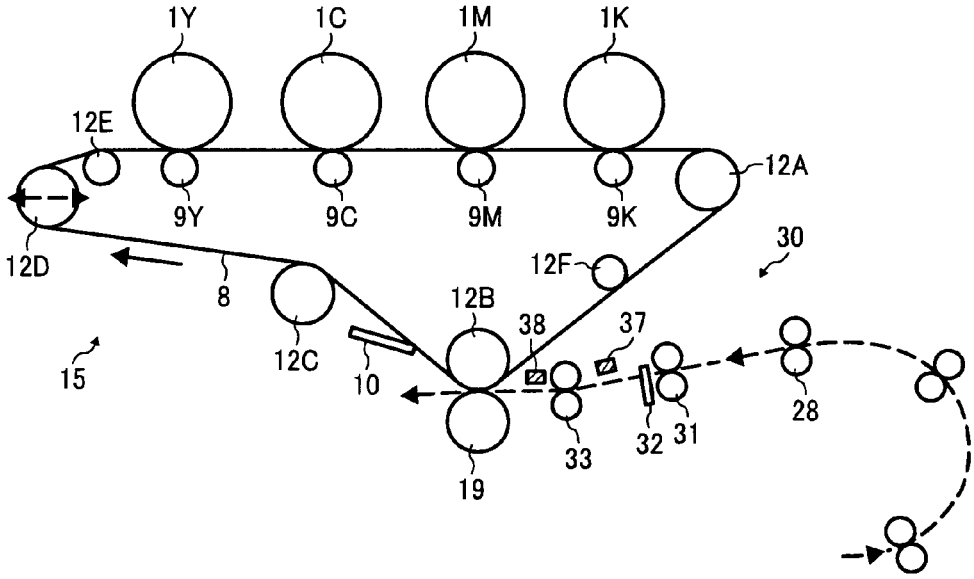
FIG. 3 is a schematic diagram of a conveying device and an area near the device of FIG. 1.

Referring to FIG. 3, the intermediate transfer belt unit 15 includes the intermediate transfer belt 8, four transfer rollers 9Y, 9M, 9C, and 9K, a drive roller 12A, an opposed roller 12B, tension rollers 12C to 12F, and an intermediate-transfer-belt cleaning unit 10. The intermediate transfer belt 8 is stretched and supported by the rollers 12A to 12F, and is endlessly moved in the direction of arrow in FIG. 3 by the rotation of the roller (drive roller) 12A.

The four transfer rollers 9Y, 9M, 9C, and 9K hold the intermediate transfer belt 8 with the photosensitive drums 1Y, 1M, 1C, and 1K to form primary transfer nips, respectively. A transfer voltage (transfer bias) of which polarity reverse to the polarity of the toners is applied to the transfer rollers 9Y, 9M, 9C, and 9K.

The intermediate transfer belt 8 (image carrier) then moves in the direction of arrow to sequentially pass through the primary transfer nips at the transfer rollers 9Y, 9M, 9C, and 9K. The toner images of the colors on the photosensitive drums 1Y, 1M, 1C, and 1K are primarily transferred one on top of another onto the intermediate transfer belt 8.

Thereafter, the intermediate transfer belt 8 with the toner images superimposed one on top of another thereon reaches a position facing a secondary transfer roller 19 (image transfer unit). At this position, the opposed roller 12B holds the intermediate transfer belt 8 with the secondary transfer roller 19 to form a secondary transfer nip (image transfer unit). The four-color toner image formed on the intermediate transfer belt 8 is transferred to a recording medium P such as a transfer paper conveyed to the position of the secondary transfer nip. At this time, some non-transferred toner which is not transferred to the recording medium P remains on the intermediate transfer belt 8.

The intermediate transfer belt 8 then reaches a position of the intermediate-transfer-belt cleaning unit 10, where the non-transferred toner is removed from the intermediate transfer belt 8.

A series of the transfer processes performed on the intermediate transfer belt 8 are finished.

Referring to FIG. 1, the recording medium P having reached the position of the secondary transfer nip is conveyed from a paper feed unit 26 provided in the lower side of the body of the image forming apparatus 100 (or a paper feed unit provided in the side face thereof) through a paper feed roller 27, the conveying device 30, or the like.

More specifically, a plurality of recording media P such as transfer papers are stored in the paper feed unit 26. The paper feed roller 27 is rotated in the counterclockwise direction in FIG. 1, and the top recording medium P is fed to the conveying device 30.

The recording medium P is conveyed up to the conveying device 30, where it is subjected to its longitudinal registration correction (misalignment correction of the recording medium in the conveying direction), to its lateral registration correction (misalignment correction thereof in the width direction), and to its skew correction. Thereafter, the recording medium P is conveyed to the secondary transfer nip (image transfer unit) by matching the timing to the color image on the intermediate transfer belt 8. In this manner, a desired color image is transferred to the recording medium P. The configuration and the operations of the conveying device 30 are explained in more detail below with reference to FIG. 3 to FIGS. 7A to 7D.

Thereafter, the color image is transferred to the recording medium P at the position of the secondary transfer nip, and the recording medium P with the color image thereon is conveyed to a position of a fixing unit 20. At this position, the color image formed on the surface of the recording medium P is fixed thereon under heat and pressure by a fixing roller and a pressing roller.

The recording medium P is then discharged to the outside of the apparatus by a pair of paper discharging rollers (not shown). The discharged recording medium P is sequentially stacked as an output image on a stack portion.

A series of the imaging processes in the image forming apparatus are completed in the above manner. A linear speed through the processes in the image forming apparatus according to embodiments, such as a moving speed of the intermediate transfer belt 8 and a conveying speed of the recording medium P, is set to about 400 mm/sec.

The configuration and the operation of the developing unit in the imaging unit are explained in more detail below with reference to FIG. 2.

The developing unit 5Y includes a developing roller 51Y facing the photosensitive drum 1Y, a doctor blade 52Y facing the developing roller 51Y, two conveyor screws 55Y provided in a developer container, a toner supply path 43Y communicating with the developer container through an opening, and a density detecting sensor 56Y that detects toner density in the developer. The developing roller 51Y includes a magnet fixed to the inner side thereof and a sleeve rotating around the magnet. Contained in the developer container is a two-component developer G including carrier and toner.

The developing unit 5Y configured in the above manner operates as follows.

The sleeve of the developing roller 51Y rotates in the direction of arrow in FIG. 2. The developer carried on the developing roller 51Y by a magnetic field formed by the magnet moves along the developing roller 51Y with a rotation of the sleeve. Here the developer in the developing unit 5Y is controlled so that a rate of the toner in the developer (toner density) falls within a predetermined range.

Thereafter, the toner supplied to the developer container circulates through two developer containers separated from each other while being mixed with the developer and stirred by the two conveyor screws 55Y, that is, the toner moves in the vertical direction in FIG. 2. The toner in the developer is attracted to the carrier due to triboelectric charging with the carrier, and the toner with the carrier is carried on the developing roller 51Y due to magnetic force formed thereon.

The developer on the developing roller 51Y is conveyed in the direction of arrow in FIG. 2 to reach a position of the doctor blade 52Y. An amount of the developer on the developing roller 51Y is optimized at this position, and is conveyed to a position facing the photosensitive drum 1Y (developing area). The toner is attracted to a latent image formed on the photosensitive drum 1Y by the electric field produced in the developing area. Thereafter, some developer remaining on the developing roller 51Y reaches the upper side of the developer container with a rotation of the sleeve, where the developer is separated from the developing roller 51Y.

The conveying device 30 specific to the first embodiment is explained in detail below with reference to FIGS. 3, 4, and FIGS. 6A to 6D.

Figure 4:
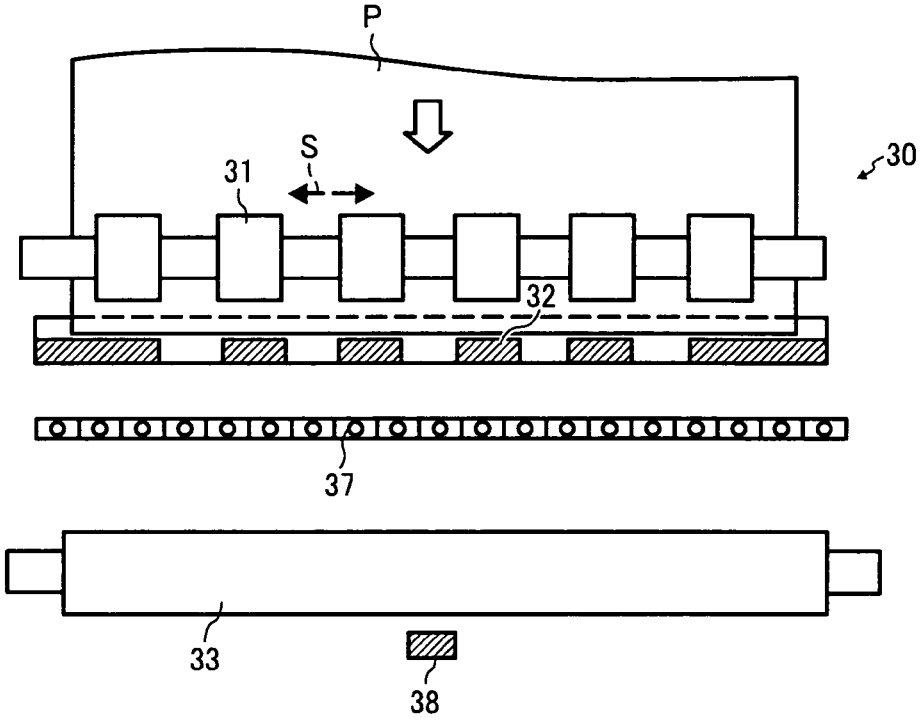
FIG. 4 is a top view of a conveying device according to a first embodiment of the present invention when viewed from its width direction.

Referring to FIGS. 3 and 4, the conveying device 30 includes a pair of conveying rollers 28, a pair of holding rollers 31 being a lateral registration correcting unit, a butting member 32 being a first longitudinal registration correcting unit, and a pair of registration rollers 33 being a second longitudinal registration correcting unit, which are arranged along a conveying path (path indicated by a dotted line in FIG. 3) of the recording medium. Moreover, a contact image sensor (CIS) 37 being a detector is disposed between the butting member 32 and the registration rollers 33. Further, a photosensor 38 is disposed between the registration rollers 33 and the secondary transfer nip (image transfer unit). It is noted that the butting member 32 as shown in FIG. 3, FIGS. 6A to 6D, and FIG. 7A to FIG. 7D includes a butting member 321 according to the second embodiment as shown in FIG. 5 unless otherwise specified.

The butting member 32 as the first longitudinal registration correcting unit is a metal plate having a butting surface (which is divided into a plurality of parts in the width direction) against which the leading edge of the recording medium P butts. The leading edge of the recording medium P butts against the butting member 32 to correct the longitudinal registration of the recording medium P. Moreover, the leading edge thereof butts against the butting member 32 to correct the skew of the recording medium P. The butting member 32 is configured so as to open or close the conveying path of the recording media P. More specifically, the butting member 32 moves upward in FIG. 3 at a predetermined timing by the drive of a cam mechanism (not shown) engaged with the butting member 32 to close the conveying path, or moves downward in FIG. 3 to open the conveying path.

Furthermore, in the conveying device 301 according to the second embodiment, the butting member 321 is configured so that the tilt (or skew) thereof in the width direction with respect to the conveying direction of the recording media P can be adjusted. Namely, an adjusting unit is provided so that the tilt of the butting member 321 in the width direction with respect to the conveying direction can be adjusted. More specifically, referring to FIG. 5, the butting member 321 is configured so as to be bidirectionally pivotable (X1 direction or X2 direction) with respect to a pivotal center 32*a* by a drive mechanism (not shown) that functions as the adjusting unit. In the second embodiment, the butting member 321 is configured so as to pivot in a range of ±5 degrees around the pivotal center 32*a*.

By configuring the butting member 321 in the above manner, even if the butting member 321 is not accurately assembled in the conveying device 301 and is therefore tilted in the width direction with respect to the conveying direction of the recording media P, the tilt can be adjusted afterward by the adjusting unit and the butting member 321 (butting surface) can be corrected to a substantially right angle with respect to the conveying direction. Consequently, it is possible to accurately correct the skew of the recording medium P to be conveyed to the secondary transfer nip (image transfer unit).

The holding rollers 31 as the lateral registration correcting unit form the pair, as explained above, each of which includes a plurality of separated roller units in the width direction, and are provided on the upstream side of the butting member 32 in the conveying direction of the recording medium P. The holding rollers 31 are configured so that the pair can be brought into contact with or can be separated from each other (6A to 6D) by the drive mechanism (not shown), and are also configured so that the roller pair can move in the width direction (direction of dashed arrow S in FIG. 4). The holding rollers 31 hold the recording medium P which is kept butted against the butting member 32, and then the holding rollers 31 move in the width direction. The lateral registration of the recording medium P is thereby corrected.

The registration rollers 33 as the second longitudinal registration correcting unit form the pair, as explained above, provided on the downstream side of the butting member 32 in the conveying direction of the recording media P. The lateral registration of the recording medium P is corrected by the holding rollers 31 and then the recording medium P butts against the nip portion of the registration rollers 33, where the longitudinal registration thereof is again corrected. The leading edge of the recording medium P butts against the registration rollers 33, and the skew of the recording medium P can thereby also be corrected.

The CIS 37 as a lateral registration misalignment detector is formed of a plurality of photosensors including light-emitting elements such as light emitting diodes (LEDs) and light-receiving elements such as photodiodes which are juxtaposed to each other in the width direction, and detects positions of both ends of the recording medium P in the width direction to detect an amount of misalignment of the lateral registration. The holding rollers 31 correct the lateral registration based on the result of detection by the CIS 37.

The CIS 37 further detects an amount of skew in the width direction of the recording medium P moving along the conveying path, from the timing of detecting positions of both ends of the recording medium P in the width direction (detection time lag). The tilt of the butting member is variably controlled based on the result of detection (the amount of skew). The variable control is explained later with reference to FIGS. 6A to 6D and FIGS. 7A to 7D.

The photosensor 38 is disposed on the downstream side of the registration rollers 33 in the conveying direction of the recording medium P, and optically detects the leading edge of the recording medium P conveyed from the registration rollers 33. A conveying timing of the recording medium P to be conveyed by the registration rollers 33 toward the secondary transfer nip is finely adjusted based on the result of detection by the photosensor 38.

The operation of the conveying device 30 configured in the above manner is explained in detail below with reference to FIGS. 6A to 6D and FIGS. 7A to 7D.

Figure 6A:
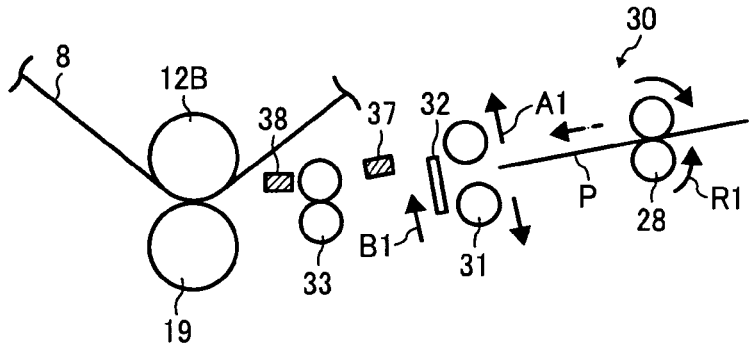
FIGS. 6A to 6D are schematic diagrams of how the conveying devices operate.

At first, as shown in FIG. 6A, the recording medium P fed from the paper feed unit 26 is conveyed to the position of the butting member 32, or conveyed in the direction of the dashed arrow, with a rotation of the conveying rollers 28 in the direction of R1. During this operation, the holding rollers 31 move in each direction of opening the conveying path (direction of arrow A1), and the butting member 32 moves in the direction of closing the conveying path (direction of arrow B1).

Figure 6B:
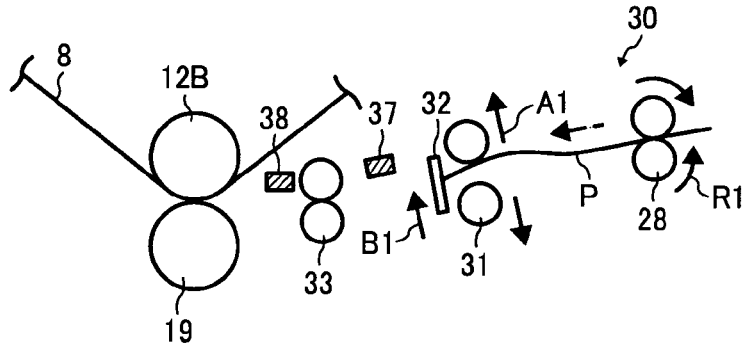
Figure 6C:
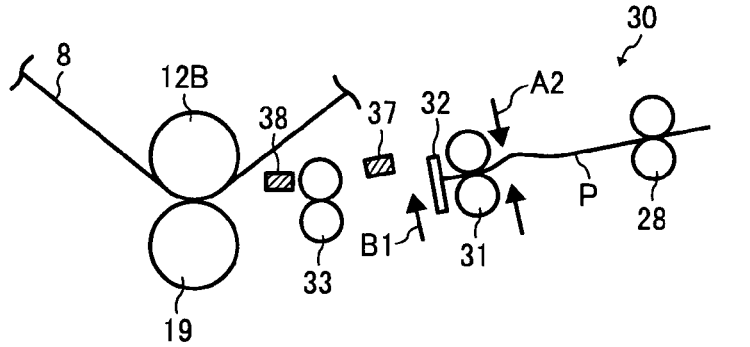

Thereafter, as shown in FIG. 6B, the leading edge of the recording medium P butts against the butting member 32 to stop in a state where the conveying speed decreases due to decelerating rotation of the conveying rollers 28. As shown in FIG. 6C, the rotation of the conveying rollers 28 is stopped and at the same time the holding rollers 31 move in each direction of holding the recording medium P (direction of A2). At this time, part of the recording medium P warps.

As explained above, the leading edge of the recording medium P butts against the butting member 32 to thereby correct the skew of the recording medium P. More specifically, even if the recording medium P is conveyed in its oblique posture with respect to the conveying direction or even if it is skewed, one end of the leading edge first butts against the butting member 32 and the other end thereof pivotally moves around the one end to also butt against the butting member 32, and thus the skew of the recording medium P is finally corrected.

The longitudinal registration of the recording medium P is further corrected. Thereafter, the holding rollers 31 are rotated and the recording medium P is thereby conveyed toward the registration rollers 33 by matching the timing to the color image on the intermediate transfer belt 8.

Figure 6D:
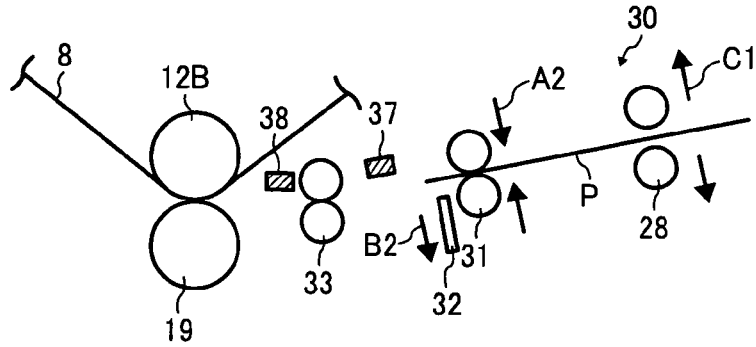

Thereafter, as shown in FIG. 6D, the conveying rollers 28 move in each direction of opening the conveying path (direction of C1), and the butting member 32 also moves in the direction of opening the conveying path (direction of B2). In other words, the recording medium P is held only by the holding rollers 31.

At the same time, there may be a case where the leading edge of the recording medium P which butts against the butting member 32 is displaced depending on a difference in rigidity of recording media P. In this case, the longitudinal registration corrected by butting against the butting member 32 is displaced. The misalignment of the longitudinal registration easily occurs when a particularly thin recording medium P (thin paper) is used.

Figure 7A:
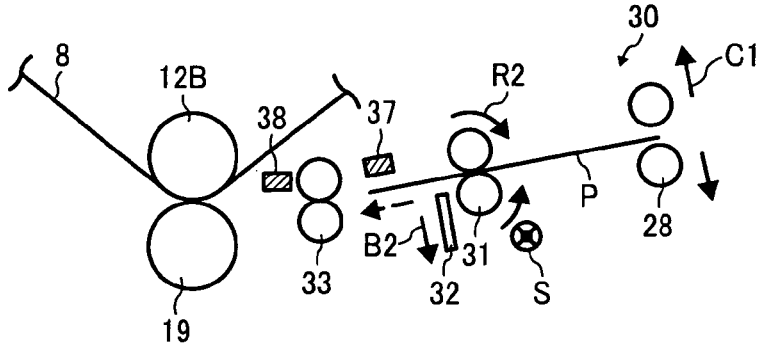
FIGS. 7A to 7D are schematic diagrams of how the conveying devices operate, following the operations in FIGS. 6A to 6D.

Thereafter, as shown in FIG. 7A, the recording medium P is conveyed to the position of the registration rollers 33, or conveyed in the direction of the dashed arrow, by a rotation of the holding rollers 31 in the direction of R2. During this operation, the CIS 37 detects an amount of misalignment of the recording medium P in the lateral registration, and the holding rollers 31 move in the vertical direction in this figure (direction of S) so as to compensate for the amount of misalignment. For example, referring to FIG. 4, if the lateral registration of the recording medium P is displaced rightward by 3 millimeters, then the holding rollers 31 holding the recording medium P are shifted leftward by 3 millimeters.

As explained above, the recording medium P is conveyed by the holding rollers 31 to the registration rollers 33 in a state where the conveying path is opened by the butting member 32, and at the same time the lateral registration is corrected.

Figure 7B:
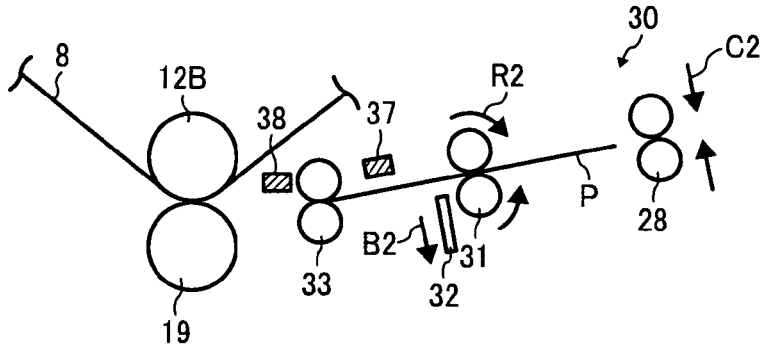

Further, as shown in FIG. 7B, the tilt of the butting member 32 can be adjusted, or rotated in the direction of X, based on the result of detection (amount of skew) by the CIS 37 as the detector. For example, referring to FIG. 5, if the CIS 37 detects that the recording medium P is skewed by 2 degrees in the direction of X2, then the adjusting unit tilts the butting member 321 by 2 degrees in the direction of X1. With this tilting, the skew of the recording medium P that passes the butting member 321 is accurately corrected.

In the embodiments, the CIS 37 is disposed on the downstream side of the butting member 32 in the conveying direction of the recording medium P. However, the CIS 37 can also be disposed on the upstream side of the butting member 32 in the conveying direction thereof. In this case, the tilt of the butting member 32 is adjusted based on the amount of skew of the recording medium P conveyed to the butting member 32.

Thereafter, as shown in FIG. 7B, the leading edge of the recording medium P of which lateral registration has been corrected butts against the registration rollers 33 to stop. At this time, the conveying rollers 28 move in each direction of conveying the recording medium P (direction of C2) to be in the conveyance standby state of a next recording medium.

Figure 7C:
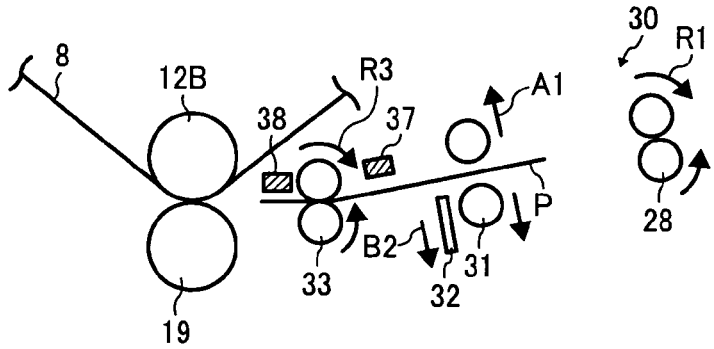

As shown in FIG. 7C, the rotation of the conveying rollers 28 is restarted, and the holding rollers 31 move in each direction of releasing the recording medium P (direction of A1). When the registration rollers 33 are rotated and the photosensor 38 detects the leading edge of the recording medium P, then the rotation of the registration rollers 33 is temporarily stopped.

Figure 7D:
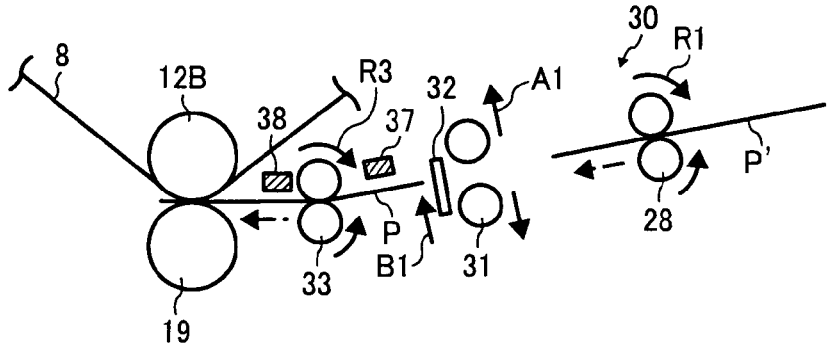

The longitudinal registration of the recording medium P is then corrected. Thereafter, as shown in FIG. 7D, the recording medium P is conveyed toward the secondary transfer nip by matching the timing to the color image on the intermediate transfer belt 8. The color image is transferred to a desired position on the recording medium P in the above manner.

The registration rollers 33 are configured so as to vary the number of revolutions by the drive of a variable drive motor (not shown). With this operation, the conveying speed of the recording medium P to be conveyed from the registration rollers 33 toward the secondary transfer nip can be adjusted, which allows more accurate adjustment of the longitudinal registration.

At the same time, the butting member 32 moves in the direction of closing the conveying path (direction of B1), to prepare longitudinal registration correction of a next recording medium P' to be conveyed by the conveying rollers 28.

As shown in FIG. 7B, the leading edge of the recording medium P butts against the nip portion of the registration rollers 33, to also correct the skew of the recording medium P. More specifically, even if the recording medium P is skewed, one end of the leading edge first butts against the nip portion of the registration rollers 33 and the other end thereof pivotally moves around the one end to also butt against the nip portion, and thus the skew of the recording medium P is finally corrected.

As explained above, in the embodiments, even if the longitudinal registration once corrected at the position of the butting member 32 is displaced afterward due to different types of recording media P or due to correction of the lateral registration thereof, the longitudinal registration is again corrected at the position of the registration rollers 33 (position immediately upstream of the image transfer unit). In other words, the longitudinal registration is corrected in two stages. This allows accurate correction of the longitudinal registration.

Moreover, in the second embodiment, the tilt of the butting member 321 is variably controlled based on the type of the recording medium P.

Figure 8A:
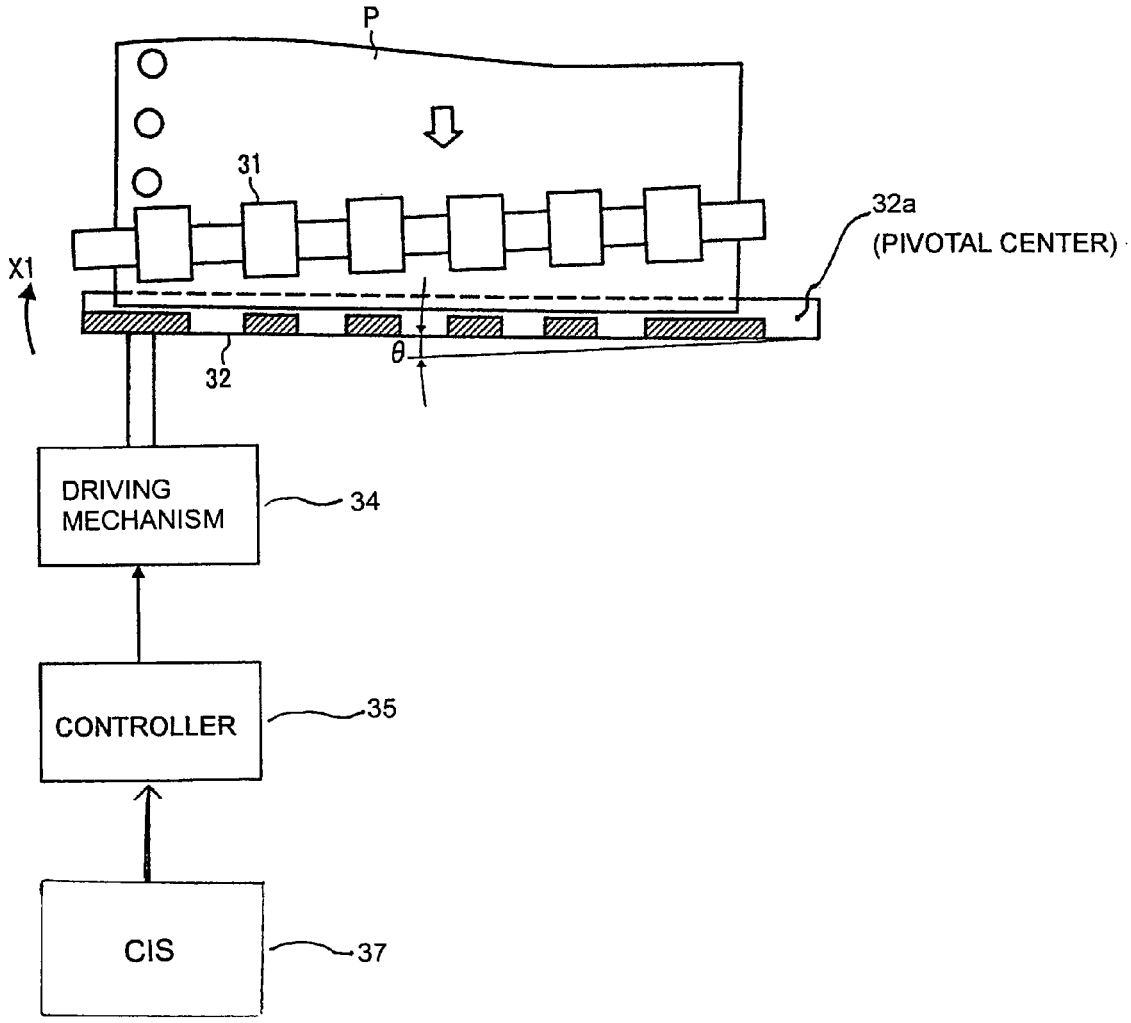
FIGS. 8A and 8B are schematic diagrams of how a recording medium skews.
Figure 8B:
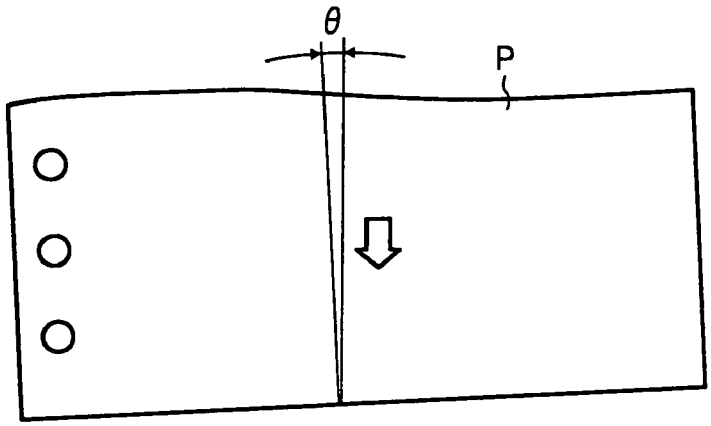

For example, a recording medium P (hole paper) having holes along one end thereof in the width direction as shown in FIG. 8A is conveyed (passed). And, after the recording medium P passes through the butting member 321, the one end of the recording medium P having the holes tends to be skewed so that the one end thereof comes before the other end of the recording medium P having no holes, as shown in FIG. 8B. This is because the warp occurring upon butting of the recording medium P against the butting member 321 increases due to lower rigidity of the one end than that of the other end without the holes, which causes the one end to be more largely displaced toward the downstream side than that of the other end when the recording medium P butted against the butting member 321 is released therefrom.

Figure 9:
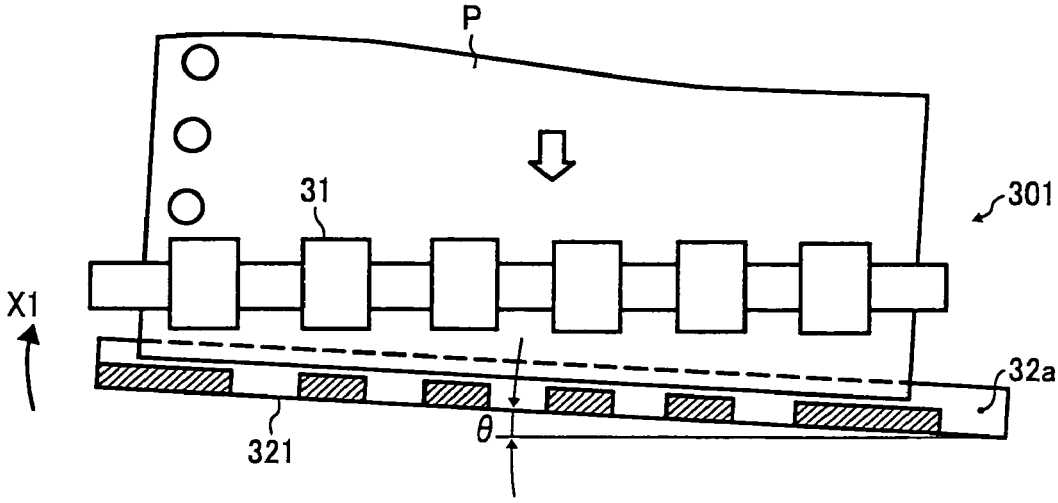
FIG. 9 is a schematic diagram of an operation of a butting member that corrects the skew of the recording medium in FIGS. 8A and 8B.

When the CIS 37 detects that the recording medium P is skewed by an angle θ with respect to the conveying direction as shown in FIG. 8B, the adjusting unit tilts the butting member 321 by the angle θ in the direction of X1 as shown in FIG. 9. With this tilting, the skew of the recording medium P to be passed is accurately corrected, and thus the image can be transferred to a desired position on the recording medium P.

Furthermore, in the second embodiment, the tilt of the butting member 321 can be adjusted based on ambient temperature and humidity.

More specifically, when a specific skew tends to occur depending on a use environment (temperature and humidity) of the device, the use environment is first detected and then the tilt of the butting member 321 is adjusted based on the result of detection. The adjustment allows minimization of the skew of the recording medium which may occur caused by the use environment.

As explained above, the conveying device 301 according to the second embodiment includes the butting member 321 (first longitudinal registration correcting unit), the holding rollers 31 (lateral registration correcting unit), and the registration rollers 33 (second longitudinal registration correcting unit). Thus, it is possible to accurately correct the misalignment of the recording medium P to be conveyed to the secondary transfer nip (image transfer unit).

Moreover, the conveying device 301 according to the second embodiment is configured so as to adjust the tilt of the butting member 321 in the width direction with respect to the conveying direction of the recording medium P. Thus, it is possible to accurately correct the skew of the recording medium P to be conveyed to the secondary transfer nip or to the image transfer unit.

In the embodiments, the present invention is applied to the image forming apparatus using the intermediate transfer element such as the intermediate transfer belt 8 as the image carrier. However, the present invention can also be applied to any image forming apparatus using a photosensitive element such as a photosensitive drum and a photosensitive belt as the image carrier. Also in this case, to transfer an image formed on the photosensitive element to the recording medium at the image transfer unit, by arranging the first longitudinal registration correcting unit 32, the lateral registration correcting unit 31, and the second longitudinal registration correcting unit 33 in the conveying device that conveys the recording medium to the image transfer unit, the same effect as that of the embodiments can be obtained.

Further, in the embodiments, the present invention is applied to the image forming apparatus using the intermediate transfer element such as the intermediate transfer belt 8 as the image carrier. However, the present invention can also be applied to any image forming apparatus using a photosensitive element such as a photosensitive drum and a photosensitive belt as the image carrier. Also in this case, to transfer an image formed on the photosensitive element to the recording medium at the image transfer unit, by providing the butting member 321 of which tilt is adjusted in the conveying device that conveys the recording medium to the image transfer unit, the same effect as that of the embodiments can be obtained.

It will be obvious that the present invention is not limited to the embodiments and that the embodiments of the present invention can be changed to those other than the embodiments if necessary without departing from the technical ideas of the present invention. Furthermore, the number, the positions, and the shapes of the components are not limited to the embodiments. Thus, these conditions can be changed to those most appropriate for implementation of the present invention.

According to one aspect of the present invention, the conveying device includes the first longitudinal registration correcting unit, the lateral registration correcting unit, and the second longitudinal registration correcting unit, and thus it is possible to provide the conveying device and the image forming apparatus capable of accurately correcting the misalignment of the recording medium which is conveyed to the image transfer unit.

According to another aspect of the present invention, the conveying device is configured to adjust the tilt of the butting member in the width direction with respect to the conveying direction of the recording medium, and thus it is possible to provide the conveying device and the image forming apparatus capable of accurately correcting the skew of the recording medium to be conveyed to the image transfer unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conveying device that conveys a recording medium to an image transfer unit that transfers an image formed on an image carrier to the recording medium, the conveying device comprising:

a butting member against which a leading edge of the recording medium abuts and opens and closes a conveying path of the recording medium;

a detecting unit arranged on a downstream side of the butting member in a conveying direction and that detects a leading edge of the recording medium;

a longitudinal registration correcting unit that corrects misalignment of the recording medium in the conveying direction based on detection by the detecting unit after the butting member corrects a skew of the recording medium; and a lateral registration correcting unit that corrects a misalignment of the recording medium in its width direction after the butting member corrects a skew of the recording medium, wherein the longitudinal registration correcting unit that corrects misalignment of the recording medium in the conveying direction based on the detection by the detecting unit after the lateral registration correcting unit corrects the misalignment of the recording medium in the width direction.

2. The conveying device according to claim 1, wherein the butting member is configured to correct skew and misalignment in the conveying direction of the recording medium, and the longitudinal registration correction unit further corrects misalignment in the conveying direction of the recording medium.

3. The conveying device according to claim 1, wherein the lateral registration correcting unit is a pair of holding rollers configured to move in the width direction after the holding the recording medium in a state where the recording medium is butted against the butting member, and the lateral registration correcting unit is provided on an upstream side of the butting member in the conveying direction.

4. The conveying device according to claim 3, wherein the longitudinal registration correcting unit is a pair of registration rollers provided on a downstream side of the butting member in the conveying direction, the holding rollers convey the recording medium to the registration rollers in a state where the conveying path is opened by the butting member, and the longitudinal registration correcting unit corrects the misalignment of the recording medium in the width direction.

5. The conveying device according to claim 4, wherein when the registration rollers convey the recording medium to the image transfer unit, the holding rollers release the recording medium.

6. The conveying device according to claim 4, wherein the detecting unit is arranged between the holding rollers and the registration rollers and detects the misalignment of the recording medium in the width direction, wherein the holding rollers correct the misalignment of the recording medium in the width direction based on a result of detection by the detecting unit.

7. The conveying device according to claim 4, wherein the registration rollers are configured to change a speed of conveying the recording medium.

8. The conveying device according to claim 1, wherein butting member and the longitudinal registration correcting unit further correct a skew of the recording medium.

9. An image forming apparatus comprising:

a conveying device that conveys a recording medium to an image transfer unit that transfers an image formed on an image carrier to the recording medium, the conveying device including a butting member against which a leading edge of the recording medium abuts and opens and closes a conveying path of the recording medium;

a detecting unit arranged on a downstream side of the butting member in a conveying direction and that detects a leading edge of the recording medium;

a longitudinal registration correcting unit that corrects the misalignment of the recording medium in the conveying direction based on detection by the detecting unit after the butting member corrects a skew of the recording medium; and a lateral registration correcting unit that corrects a misalignment of the recording medium in its width direction after the butting member corrects a skew of the recording medium, wherein the longitudinal registration correcting unit that corrects misalignment of the recording medium in the conveying direction based on the detection by the detecting unit after the lateral registration correcting unit corrects the misalignment of the recording medium in the width direction.

* * * * *